US005513960A

United States Patent [19]

Uemoto

[11] Patent Number: 5,513,960

[45] Date of Patent: May 7, 1996

[54] ROTARY-VANE PUMP WITH IMPROVED DISCHARGE RATE CONTROL MEANS

[75] Inventor: Makoto Uemoto, Atsugi, Japan

[73] Assignee: Unisia Jecs Corporation, Atsugi, Japan

[21] Appl. No.: 178,491

[22] Filed: Jan. 7, 1994

[30] Foreign Application Priority Data

Jan. 12, 1993 [JP] Japan ..... 5-003060 U

[51] Int. Cl.[6] ..... F04C 15/04

[52] U.S. Cl. ..... 417/300; 417/310; 417/279

[58] Field of Search ..... 417/279, 300, 417/310

[56] References Cited

U.S. PATENT DOCUMENTS

| | | | |
|---|---|---|---|
| 2,582,753 | 1/1952 | Herbelleau | 417/279 X |
| 5,192,196 | 3/1993 | Gettel . | |
| 5,209,648 | 5/1993 | Ishizaki et al. . | |
| 5,236,315 | 8/1993 | Hamao et al. . | |

FOREIGN PATENT DOCUMENTS

| | | |
|---|---|---|
| 4119207 | 12/1991 | Germany . |
| 4-78076 | 8/1992 | Japan . |

OTHER PUBLICATIONS

Article in Olhydraulik By Von Dipl.–Ing. G. Bauer entitled Dozent an der Fachhochschule Ulm, publ. 1974.

*Primary Examiner*—Richard E. Gluck
*Attorney, Agent, or Firm*—Bachman & LaPointe

[57] ABSTRACT

A rotary-vane pump includes a pressure chamber in which a constant pressure is developed, and a pair of discharge passages connecting the pressure chamber to a discharge port. On of the discharge passages is provided with only an orifice so as to supply a constant flow rate of fluid to the discharge port. The other of the discharge passages is provided with an orifice and a flow control valve. The flow control valve controls opening and closing of the other discharge passage in such a manner that the rate of flow through the other discharge passage decreases with increasing rotational speed of the pump. The flow control valve includes a spool having a pair of axially spaced first and second lands, an annular relieved section between the first and second lands, and a guide post. The annular relieved section forms an annular chamber constituting part of the other discharge passage. A spring for urging the spool in the direction to close the other discharge passage, has one axial end retained by the second land and the guide post. The spring is disposed in a spring chamber which is fluidly separated from the annular chamber by the second land. The spring chamber is in fluid communication with the discharge port.

6 Claims, 2 Drawing Sheets

ROTARY-VANE PUMP WITH IMPROVED DISCHARGE RATE CONTROL MEANS

BACKGROUND OF THE INVENTION

1. Field of the Invention

The present invention relates to rotary-vane pumps which may be utilized in vehicle power steering systems, and more particularly to a discharge rate control mechanism for such pumps for providing a desired discharge rate variation characteristic.

2. Description of the Prior Art

A pump of this kind is disclosed in U.S. Pat. No. 5,209,648. In this known pump, a flow control valve and a throttling insert are utilized for obtaining a delivery flow having a decreasing delivery tendency with rising rotational speed.

Another pump is known from Japanese Patent Provisional Publication No. 4-78076. This known pump has a pair of first and second discharge passages respectively provided with throttling means, a first flow control valve for controlling the pressure differential across each throttling means at a constant value, and a second flow control valve disposed in the second discharge passage for controlling the delivery flow therethrough in accordance with a back pressure which is acting on a vane and is variable with variation of rotational speed of the pump, i.e., the second flow control valve is movable in response to a back pressure acting on a vane for closing the discharge passage increasingly as the back pressure increases. By this, the rate of flow through the first discharge passage is regulated to a constant value irrespective of rotational speed of the pump, whereas the rate of flow through the second discharge passage decreases with increasing rotational speed of the pump. The second flow control valve however is not stable in operation since the fluid flow having passed the second flow control valve is partly delivered through a branch passage in which a spring for urging a valve spool in the direction to open the discharge passage is installed and further since the delivery flow through the branch passage is liable to be disturbed by the spring to apply a largely fluctuating fluid pressure on the spool.

SUMMARY OF THE INVENTION

According to an aspect of the present invention, there is provided a rotary-vane pump which comprises pumping means. The pumping means includes a plurality of pumping chambers, a plurality of vanes, an undervane balancing chamber for developing therein a control fluid pressure variable in proportion to rotational speed of the pump, and an outlet port communicable with the pumping chambers. The rotary-vane pump further comprises a housing accommodating the pumping means to form therebetween a pressure chamber in communication with the outlet port and having a discharge port, and discharge passage means for providing communication between the pressure chamber and the discharge port. The discharge passage means includes a pair of discharge passages which are provided with orifices, respectively. The rotary-vane pump further comprises flow control valve means for controlling fluid flow through one of the discharge passages. The flow control valve means includes a spool bore extending across the one discharge passage, and a spool axially movable in the spool bore and forming at one axial end a control pressure chamber and at the other end a spring chamber. The control pressure chamber is in communication with the undervane balancing chamber so that the spool is urged by the control fluid pressure in the direction to close the one discharge passage. The control valve means further includes a spring disposed in the spring chamber for urging the spool in the direction to open the one discharge passage. The spool has a pair of axially spaced first and second lands, an annular relieved section between the first and second lands and a guide post section protruding from the second land into the spring chamber. The spring has one end retained by the second land and the guide post section. The relieved section cooperates with the spool bore to define an annular chamber which constitutes part of the second discharge passage to fully or partly open the second discharge passage.

According to another aspect of the present invention, there is provided a rotary-vane pump which comprises pumping means including a plurality of pumping chambers, control pressure producing means for producing a control fluid pressure variable in response to rotational speed of the pump, and an outlet port communicable with the pumping chambers. The rotary-vane pump further comprises a housing accommodating the pumping means and having a discharge port, and discharge passage means for providing communication between the outlet port and the discharge port. The discharge passage means includes a pair of discharge passages which are provided with orifices, respectively. The rotary-vane pump further comprises first flow control valve means for regulating the pressure differential across each of the orifices to a constant value, and second flow control valve means for controlling fluid flow through one of the discharge passages. The second flow control valve means including a spool bore extending across said one discharge passage, a spool axially movable in the spool bore and forming at one axial end a control pressure chamber and at the other end a spring chamber. The control pressure chamber is in communication with the control pressure producing means so that the spool is urged by the control fluid pressure in the direction to close the one discharge passage. The second flow control valve means further includes a spring disposed in the spring chamber for urging the spool in the direction to open the one discharge passage. The spool has a pair of axially spaced first and second lands, an annular relieved section between the first and second lands and a guide post section protruding from the second land into the spring chamber. The spring has one end retained by the second land and the guide post section. The relieved section cooperates with the spool bore to define an annular chamber which constitutes part of the second discharge passage to fully or partly open the second discharge passage.

According to a further aspect of the present invention, there is provided a rotary-vane pump which comprises pumping means. The pumping means includes a rotor, a plurality of vanes radially movably installed on the rotor, a cam ring accommodating the rotor with the vanes to form a plurality of pumping chambers, a plurality of undervane working chambers variable in volume in response to radial movement of the vanes, a plurality of undervane balancing chambers communicated with the undervane working chambers, orifice means for developing in a predetermined group of the undervane balancing chambers a control fluid pressure variable in proportion to rotational speed of the pump, an outlet port communicable with the pumping chambers. The rotary-vane pump further comprises a housing accommodating the pumping means to form, around the cam ring, a pressure chamber in communication with the outlet port and having a discharge port, first flow control valve means associated with the pressure chamber for regulating a fluid pressure in the pressure chamber to a constant value irrespective of rotational speed of the pump, and discharge passage means for providing communication between the pressure chamber and the discharge port. The discharge passage means includes a pair of discharge passages which are provided with orifices, respectively. The rotary-vane pump further comprises second flow control valve means for controlling fluid flow through one of the discharge passages. The second flow control valve means includes a damper orifice, a spool bore extending across the one discharge passage, a spool axially movable in the spool bore and forming at one axial end a control pressure chamber and at the other end a spring chamber. The control pressure chamber is in communication with the predetermined group of the undervane balancing chambers by way of the damping orifice so that the spool is urged by the control fluid pressure in the direction to close the one discharge passage. The second flow control valve means further includes a spring disposed in the spring chamber for urging the spool in the direction to open the one discharge passage. The spool has a pair of axially spaced first and second lands, an annular relieved section between the first and second lands and a guide post section protruding from the second land into the spring chamber. The spring has one end retained by the second land and said guide post section. The first land is of such a length as to be capable of fully closing the one discharge passage. The relieved section cooperates with the spool bore to define an annular chamber which constitutes part of the second discharge passage to fully or partly open the second discharge passage.

Those structures are effective for solving the above noted problems inherent in the prior device.

It is accordingly an object of the present invention to provide a rotary-vane pump which makes it possible to attain a desired discharge rate variation characteristic assuredly.

It is another object of the present invention to provide a rotary-vane pump of the above described character which makes it possible to attain smooth variation of the discharge rate at all times.

It is a further object of the present invention to provide a rotary-vane pump of the above described character which is equipped with a discharge rate control mechanism which is reliable in operation and has an improved durability.

DETAILED DESCRIPTION OF THE PREFERRED EMBODIMENT

Figure 1:
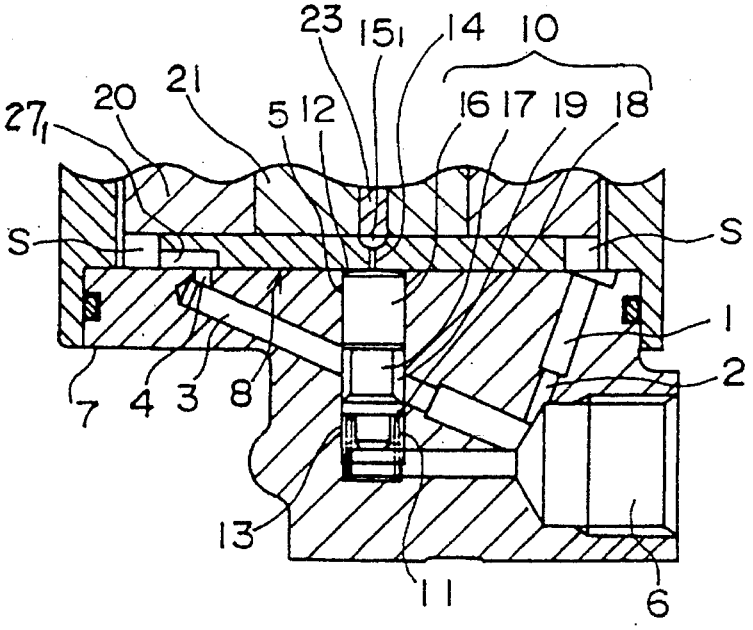
FIG. 1 is a sectional view taken along the line I—I of FIG. 2 and shows a novel important portion of a rotary-vane pump according to an embodiment of the present invention.

Referring to first to FIG. 1, a rotary vane pump includes a housing 7 and a pumping means 8 accommodated within the housing 7. The housing 7 is formed with a first discharge passage 1, a second discharge passage 3, a spool bore 5, and a discharge port 6.

Figure 3:
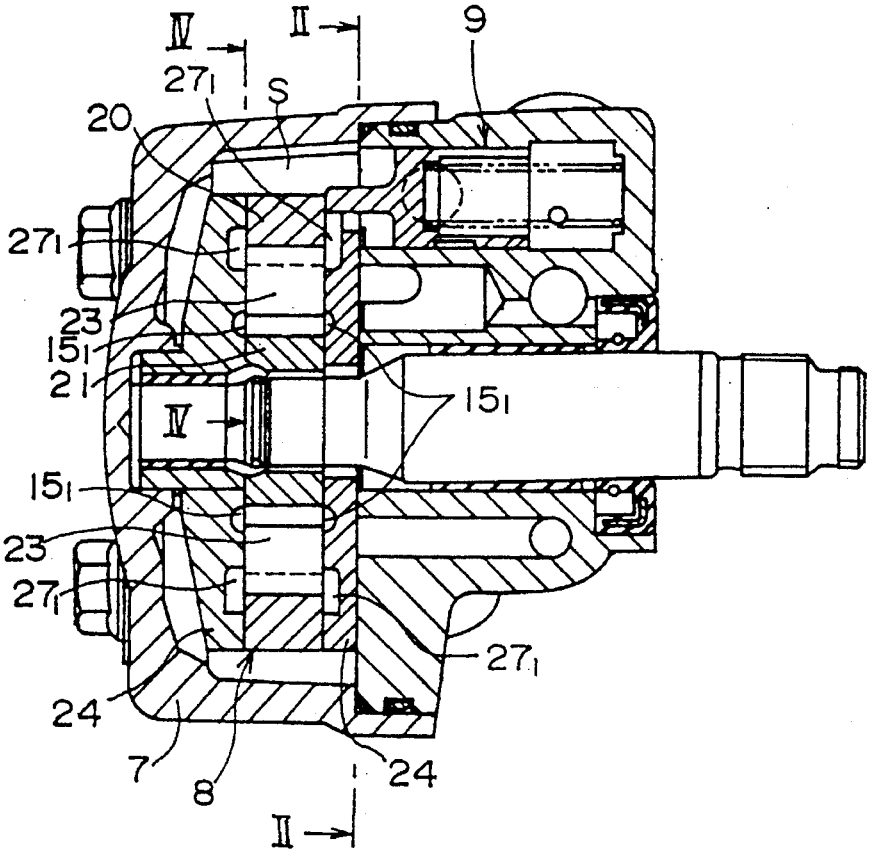
FIG. 3, is a longitudinal sectional view of a rotary-vane pump in which the present invention is embodied.

The first and second discharge passages 1 and 3 are provided with a main orifice 2 and an auxiliary orifice 4, respectively. The first and second discharge passages and 3 are communicated at one end with a pressure chamber "S" and at the other end with the discharge port 6. The pressure chamber "S" is associated with a flow control valve 9 as shown in FIG. 3 so that the pressure in the pressure chamber "S" is regulated to a constant value, i.e., the pressure differential across the main and auxiliary orifices 2 and 4 are maintained constant, by the operation of the flow control valve 9 which is known as for example disclosed in the aforementioned U.S. Pat. No. 5,209,648, irrespective of rotational speed of the pump.

The spool bore 5 is so formed as to extend axially across the second discharge passage 3. A spool 10 is axially movably fitted in the spool bore 5. Between the spool 10 and a closed axial end of the spool bore 5 there is disposed a spring 11 in a loaded condition. The spool 10 is axially movable in the spool bore 5 to define at one axial end a pressure chamber 12 and at the other axial end a spring chamber 13 in which the spring 11 is installed. The pressure chamber 12 is communicated with a first group of undervane balancing chambers $\mathbf{15}_1$ by way of a damper orifice 14. The spring chamber 13 is communicated with the discharge port 6.

The spool 10 includes a pair of axially spaced first and second lands 16 and 18 and an annular relieved section 17 therebetween. The first land 16 is associated with the pressure chamber 12 and is operative to open and close the second discharge passage 3. The land 16 is of such a length as to abut upon, when moved into a position where it fully opens the second discharge passage 3, a closed axial end of the spool bore 5. The spring 11 always urges the spool 10 in the direction to open the second discharge passage 3.

The second land 18 is constructed and arranged so as to be always positioned outside of the second discharge passage 3 (i.e., so as not to close the second discharge passage 3 at any time). The annular relieved section 17 cooperates with the spool bore 5 to define an annular chamber 19 which constitutes part of the second discharge passage 3 when the first land 16 fully or partly opens the second discharge passage 3.

As shown in FIG. 3, the pumping means 8 includes a cam ring 20, a rotor 21 accommodated within the cam ring 20, a plurality of vanes 23 respectively fitted in vane slots 22 formed in the rotor 21 in such a manner as to be movable radially of the rotor 21, and a pair of side plates 24 holding the cam ring 20 therebetween. The vanes 23 are each held slidably in contact with the inner peripheral surface of the cam ring 20 to cooperate with the inner peripheral surface of the cam ring 20 and the outer peripheral surface of the rotor 21 to form a plurality of pumping chambers 25. By the bottoms of the vanes 23 and the vane slots 22 there are respectively defined a plurality of undervane working chambers 26.

Figure 2:
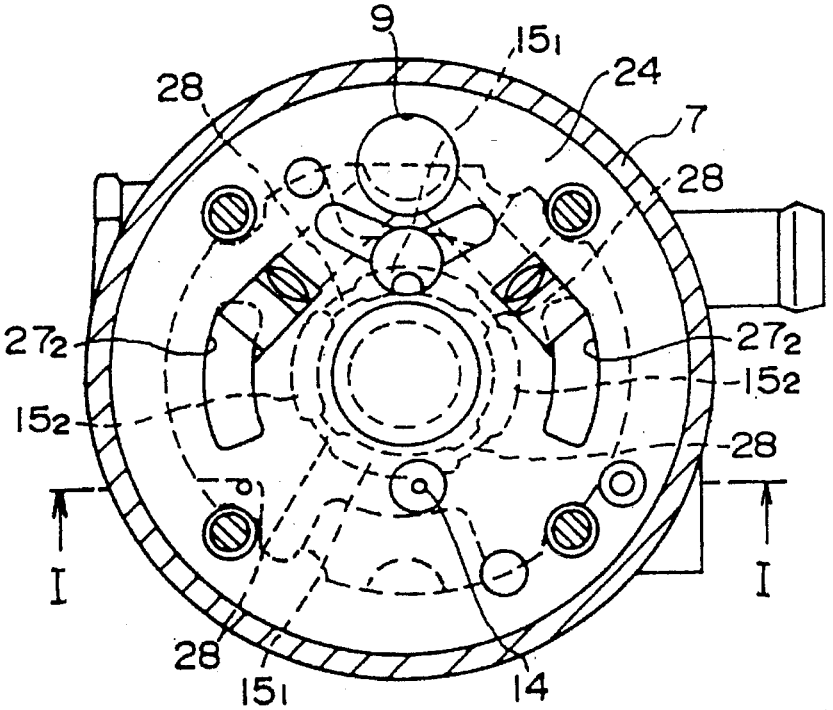
FIG. 2 is a sectional view taken along the line II—II of FIG. 3.

In the side plates 24 there are formed, as shown in FIGS. 2 and 3, outlet ports $\mathbf{27}_1$ of the pumping means 8, the above described first group of undervane balancing chambers $\mathbf{15}_1$, inlet ports $\mathbf{27}_2$ of the pumping means 8, and a second group of undervane balancing chambers $\mathbf{15}_2$. The outlet ports $\mathbf{27}_1$ are communicated with the pressure chamber "S" which is formed around the rotor 20 by the housing 7. Under a discharge mode of operation in which the vanes 23 are moving along one of discharge ramps of the cam ring 20 whilst causing decrease of the displacement of the pumping chambers 25, the outlet ports $\mathbf{27}_1$ are communicated with the pumping chambers 25 whilst the first group of undervane balancing chambers $\mathbf{15}_1$ are communicated with the undervane working chambers 26. On the other hand, under an intake mode of operation in which the vanes 23 are moving along one of intake ramps of the cam ring 20 whilst causing increase of the displacement of the pumping chambers 25, the inlet ports $\mathbf{27}_2$ are communicated with the pumping chambers 25 whilst the second group of the undervane balancing chambers $\mathbf{15}_2$ are communicated with the undervane working chambers 26.

Figure 4:
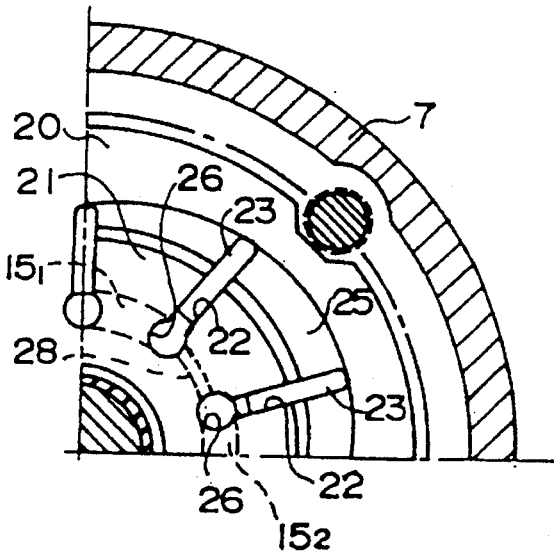
FIG. 4 is a sectional view taken along the line IV—IV of FIG. 3.

The undervane balancing chambers $\mathbf{15}_1$ and $\mathbf{15}_2$ are formed into an arcuated shape and alternately arranged in a circular array as shown in FIG. 4. Between adjacent two of the undervane balancing chambers $\mathbf{15}_1$ and $\mathbf{15}_2$ there are provided orifices 28. On the other hand, the second group of the undervane balancing chambers $\mathbf{15}_2$ are connected to the outlet ports $\mathbf{27}_1$ by way of communication passages (not shown). The discharge pressure from the outlet ports $\mathbf{27}_1$ is introduced into the undervane working chambers 26 whose vanes 23 are moving along one of the intake ramps of the cam ring 20 for thereby urging the vanes 23 in the direction to protrude from the vane slots 22. In response to rotation of the rotor 21, the vanes 23 are caused to move into and out of the vane slots 22 whilst causing increase and decrease of the displacement of the undervane working chambers 26, so that under an intake mode of operation the working fluid is discharged from the second group of the undervane balancing chambers $\mathbf{15}_2$ and supplied into the corresponding undervane working chambers 26, whereas under a discharge mode of operation the working fluid is discharged from the undervane working chambers 26 and supplied into the first group of the undervane balancing chambers $\mathbf{15}_1$. Accordingly, a fluid flow of the rate proportional to rotational speed of the pump is always delivered from the first group of the undervane balancing chambers $\mathbf{15}_1$ to the second group of undervane balancing chambers $\mathbf{15}_2$ to cause a differential pressure across the orifices 28, which pressure differential is introduced into the pressure chamber 12. In the meantime, the damper orifice 14 is provided to reduce the periodic pressure variations caused in the undervane balancing chambers $\mathbf{15}_1$ at the passage of each vanes 23 through each orifices 28.

With the foregoing structure, the pressure differential across the main orifice 2 of the first discharge passage 1 is regulated to a constant value irrespective of the rotational speed of the pump, whereby the rate of flow through the main orifice 2 and toward the discharge port 6 is regulated to a constant value. On the other hand, the pressure differential across the auxiliary orifice 4 of the second discharge passage 3 is maintained substantially at a constant value irrespective of the rotational speed of the pump. However, as the fluid pressure in the undervane balancing chambers $\mathbf{15}_1$ (i.e., the fluid pressure in the undervane working chambers 26 whose vanes 23 are moving along one of the discharge ramps of the cam ring 20) which is introduced into the pressure chamber 12 by way of the damper orifice 14, increases with increasing rotational speed of the pump, the spool 10 is gradually moved, prevailing the bias of the spring 11, in the direction to close the second discharge passage 3. Thus, the second discharge passage 3 is fully opened at the low rotational speed of the pump and fully closed at the high rotational speed. At the high rotational speed of the pump, the rate of flow through the auxiliary orifice 4 toward the discharge port 6 is reduced to zero. Accordingly, a desired flow rate variation characteristic is obtained.

In the foregoing, it is to be noted that the second discharge passage 3 is fluidly separated from the spring chamber 13 by the second land 18, so that the delivery flow through the second discharge passage 3, though divided at the bore 5 into two flow sections to go round the relieved section 17 of the spool 10, can flow relatively mildly or undisturbedly without striking against the spring 11.

It is further to be noted that the spool 10 is supported by the first and second lands 16 and 18 which are arranged on the radially opposed sides of the discharge port 3, upon the inner circumferential surface of the spool bore 5, thus making it possible to prevent inclination of the spool 10 otherwise caused in case of the aforementioned prior art arrangement when the spool 10 is driven laterally by the fluid flow striking thereagainst.

What is claimed is:

1. A rotary-vane pump comprising:

pumping means including a plurality of pumping chambers, a plurality of vanes, an undervane balancing chamber for developing therein a control fluid pressure variable in proportion to rotational speed of said pump, and an outlet port communicable with said pumping chambers;

a housing accommodating said pumping means to form therebetween a pressure chamber in communication with said outlet port and having a discharge port;

discharge passage means for providing communication between said pressure chamber and said discharge port;

said discharge passage means including a pair of discharge passages which are provided with orifices, respectively; and flow control valve means for controlling fluid flow through one of said discharge passages;

said flow control valve means including a spool bore extending across said one discharge passage, a spool axially movable in said spool bore and forming at one axial end a control pressure chamber and at the other end a spring chamber, said spring chamber being in communication with said discharge port, said control pressure chamber being in communication with said undervane balancing chamber so that said spool is urged by said control fluid pressure in the direction to close said one discharge passage, and a spring disposed in said spring chamber for urging said spool in the direction to open said one discharge passage, said spool having a pair of axially spaced first and second lands, an annular relieved section between said first and second lands and a guide post section protruding from said second land into said spring chamber, said spring having one end retained by said second land and said guide post section, said relieved section cooperating with said spool bore to define an annular chamber which constitutes part of said second discharge passage to fully or partly open said second discharge passage, said annular chamber being fluidly separated from said spring chamber by said second land.

2. A rotary-vane pump according to claim 1, wherein and said first is of such a length as to be capable of fully closing said one discharge port.

3. A rotary-vane pump according to claim 1, wherein said spool bore has an axial end which said spool is brought into contact with when said spool is moved, under the urge of said spring, into a position where it fully opens said one discharge passage.

4. A rotary-vane pump according to claim 2, wherein said spool bore has another closed axial end which another axial end of said spring is brought into contact with.

5. A rotary-vane pump comprising:

pumping means including a plurality of pumping chambers, control pressure producing means for producing a control fluid pressure variable in response to rotational speed of said pump, and an outlet port communicable with said pumping chambers;

a housing accommodating said pumping means and having a discharge port;

discharge passage means for providing communication between said outlet port and said discharge port;

said discharge passage means including a pair of discharge passages which are provided with orifices, respectively;

first flow control valve means for regulating the pressure differential across said orifices to a constant value; and second flow control valve means for controlling fluid flow through one of said discharge passages;

said second flow control valve means including a spool bore extending across said one discharge passage, a spool axially movable in said spool bore and forming at one axial end a control pressure chamber and at the other end a spring chamber, said spring chamber being in communication with said discharge port, said control pressure chamber being in communication with said control pressure producing means so that said spool is urged by said control fluid pressure in the direction to close said one discharge passage, and a spring disposed in said spring chamber for urging said spool in the direction to open said one discharge passage, said spool having a pair of axially spaced first and second lands, an annular relieved section between said first and second lands and a guide post section protruding from said second land into said spring chamber, said spring having one end retained by said second land and said guide post section, said relieved section cooperating with said spool bore to define an annular chamber which constitutes part of said second discharge passage to fully or partly open said second discharge passage, said annular chamber being fluidly separated from said spring chamber by said second land.

6. A rotary-vane pump comprising:

pumping means including a rotor, a plurality of vanes radially movably installed on said rotor, a cam ring accommodating said rotor with said vanes to form a plurality of pumping chambers, a plurality of undervane working chambers variable in volume in response to radial movement of said vanes, a plurality of undervane balancing chambers communicated with said undervane working chambers, orifice means for developing in a predetermined group of said undervane balancing chambers a control fluid pressure variable in proportion to rotational speed of said pump, an outlet port communicable with said pumping chambers;

a housing accommodating said pumping means to form, around said cam ring, a pressure chamber in communication with said outlet port and having a discharge port;

first flow control valve means associated with said pressure chamber for regulating a fluid pressure in said pressure chamber to a constant value irrespective of rotational speed of said pump;

discharge passage means for providing communication between said pressure chamber and said discharge port;

said discharge passage means including a pair of discharge passages which are provided with orifices, respectively; and second flow control valve means for controlling fluid flow through one of said discharge passages;

said second flow control valve means including a damper orifice, a spool bore extending across said one discharge passage, a spool axially movable in said spool bore and forming at one axial end a control pressure chamber and at the other end a spring chamber, said spring chamber being in communication with said discharge port, said control pressure chamber being in communication with said predetermined group of said undervane balancing chambers by way of said damping orifice so that said spool is urged by said control fluid pressure in the direction to close said one discharge passage, and a spring disposed in said spring chamber for urging said spool in the direction to open said one discharge passage, said spool having a pair of axially spaced first and second lands, an annular relieved section between said first and second lands and a guide post section protruding from said second land into said spring chamber, said spring having one end retained by said second land and said guide post section, said first land being of such a length as to be capable of fully closing said one discharge passage, said relieved section cooperating with said spool bore to define an annular chamber which constitutes part of said second discharge passage to fully or partly open said second discharge passage, said annular chamber being fluidly separated from said spring chamber by said second land.

* * * * *